US007113138B2

(12) United States Patent
Hately

(10) Patent No.: US 7,113,138 B2
(45) Date of Patent: Sep. 26, 2006

(54) RADIO ANTENNAS

(76) Inventor: Maurice Clifford Hately, 6 Ash Grove, Wells, Somerset, BA5 2LX (GB)

( * ) Notice: Subject to any disclaimer, the term of this patent is extended or adjusted under 35 U.S.C. 154(b) by 0 days.

(21) Appl. No.: 10/511,576

(22) PCT Filed: Apr. 9, 2003

(86) PCT No.: PCT/GB03/01546

§ 371 (c)(1),
(2), (4) Date: Oct. 13, 2004

(87) PCT Pub. No.: WO03/090309

PCT Pub. Date: Oct. 30, 2003

(65) Prior Publication Data

US 2005/0128154 A1 Jun. 16, 2005

(30) Foreign Application Priority Data

Apr. 13, 2002 (GB) ..... 0208527.2
Sep. 5, 2002 (GB) ..... 0220608.4

(51) Int. Cl.
*H01Q 21/00* (2006.01)
*H01Q 11/12* (2006.01)

(52) U.S. Cl. ..... 343/728; 343/741; 343/866; 343/895

(58) Field of Classification Search ..... 343/741, 343/742, 745, 866, 867, 895, 906, 728
See application file for complete search history.

(56) References Cited

U.S. PATENT DOCUMENTS 2,296,356 A * 9/1942 Lindenblad ..... 343/743
3,646,562 A * 2/1972 Acker et al. ..... 343/720
3,663,362 A * 5/1972 Stix ..... 376/132
5,155,495 A 10/1992 Hately et al.
5,257,033 A * 10/1993 Roche ..... 343/742
6,025,813 A 2/2000 Hately et al.
6,164,241 A * 12/2000 Chen et al. ..... 118/723 I
6,410,449 B1 * 6/2002 Hanawa et al. ..... 438/706
2005/0202570 A1 * 9/2005 Pusiol ..... 436/173

FOREIGN PATENT DOCUMENTS

GB 2215524 9/1989
GB 2288914 11/1995
GB 2330695 4/2005

* cited by examiner

OTHER PUBLICATIONS

Frank J. Blatt "Modern Physics" 1992, p. 326 McGraw-Hill ISBN No. 0-07-11 2918-9.

*Primary Examiner*—Tan Ho
(74) *Attorney, Agent, or Firm*—Horst M. Kasper

(57) ABSTRACT

A radio transmitting or receiving antenna which is physically compact being typically no more than three percent of a wavelength in any dimension. The antenna comprises two electrical conducting surfaces (2) and (4) across which radio frequency electric field lines carrying half the power are arranged to cross radio frequency magnetic field lines carrying the remaining half power to thereby synthesize and propagate radio waves. The low impedance coaxial feeder (1) from the transmitter flows through a set of coils (3A) to (3D) wired in parallel and lying in a toroidal shape to create a circular RF magnetic field H and then enters a low impedance tap on a resonant autotransformer used to connect a high RF voltage and create a curving electromagnetic field E across the interaction zone in the volume between the upper metal cylinder (4) and the ground plane (1).

20 Claims, 5 Drawing Sheets

RADIO ANTENNAS

Figure 1A:
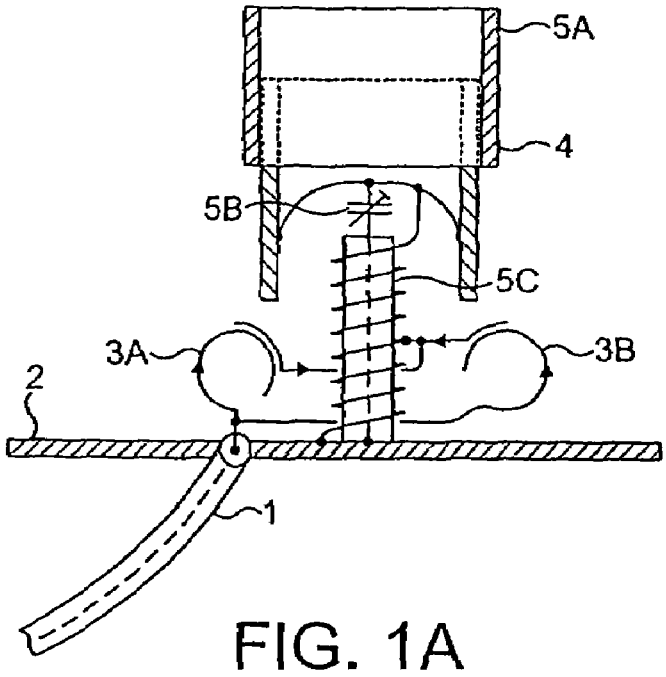

This application is a 371 of PCT/GB03/01546 filed on Apr. 9, 2003.

(b) CROSS-REFERENCE TO RELATED APPLICATIONS (not applicable)

(c) STATEMENT REGARDING FEDERALLY SPONSORED RESEARCH OR DEVELOPMENT (not applicable)

(d) THE NAMES OF THE PARTIES TO A JOINT RESEARCH AGREEMENT (not applicable)

(e) INCORPORATION-BY-REFERENCE OF MATERIAL SUBMITTED ON A COMPACT DISC (See 37 CFR 1.52(e)(5) and MPEP 608.05

Computer program listings (37 CFR 1.96(c)), "Sequence Listings" (37 CFR 1.821(c)), and tables having more than 50 pages of text are permitted to be submitted an compact discs.) or REFERENCE TO A "MICROFICHE APPENDIX" (See MPEP § 608.05(a). "Microfiche Appendices" were accepted by the Office until Mar. 1, 2001.)

(not applicable)

(f) BACKGROUND OF THE INVENTION (1) Field of the Invention

The invention is directed to radio antennas suitable for transmitting and receiving.

(2) Description of Related Art including information disclosed under 37 CFR 1.97 and 1.98.

This invention relates to developments of the antennas disclosed in patent specifications GB 2 215 524B and GB 2 330 695B. In these earlier specifications, the power to be transmitted is divided into two parts and the two half powers are used to separately drive field stimulators one of which generates radio frequency electric field lines E and the other half power generates radio frequency magnetic field lines H. In order to create radio waves by analogy with the Poynting Vector theory of the radio wave the said field lines may be thought of in terms of Quantum Mechanics as the basic virtual photons of the two energies. In order to compose real photons which can fly away with the total energy as an expanding as a powerful spherical radio wavefront at the velocity of light the following criteria must be observed; the two sets of field lines must be:

a) crossed geometrically at right angles with the correct spin for outward motion;
b) applied in the same volume of space called the interaction zone;
c) scaled so that half the power is in each field
d) proportioned so that the ratio E/H equals the impedance of space;
e) synchronised in time with zero phase error;
f) of the same curvature.

When these essential criteria are fulfilled radio waves are formed all around the field stimulators which may be very small in dimensions compared with a wavelength. Dimensions of 2 or 3 percent of the wavelength have been found to be entirely suitable for creating radio antennas of this type which are highly efficient. Convention states that an antenna must have a significant physical size compared with the half-wavelength in order to be efficient and this has affected the understanding and acceptance of the crossed field antennas made according to the said earlier patent specifications.

(g) BRIEF SUMMARY OF THE INVENTION (i) Purposes and Preparatory Steps of the Invention The achievement of success with the crossed field antennas so far disclosed has necessitated the incorporation of quite elaborate arrangements to ensure continuous synchronism because the process of moving from RF current flow to magnetic field H includes a process of mathematical differentiation which brings in a 90 degree phase advance. Thus the earlier arrangements of these devices had to involve some scheme for arranging that the currents flowing to the stimulators passed through system to cause a plus and minus 45 degree separation.

The experiences gained from working with the crossed field antenna has led to the realisation that adjustable phase is a natural feature of the tunable parallel resonant electrical circuit so, if therefore a single resonant circuit can be arranged to stimulate the two fields required to create the radio waves it would be possible to phase up a crossed field antenna by merely adjusting the resonant frequency to the transmit frequency.

Experiments have proved successful when the low impedance feed current to the low voltage tap on the primary of the resonating autotransformer is passed via H field stimulator coils placed around the antenna in the space above the ground plane and connected in parallel so that their reactance is low at the frequency of operation, but with cumulative magneto-motive force.

As this type of antenna, according to this invention, is so small, the generic name "Radio Photon Antenna" has been adopted.

(ii) Brief Description of the Invention

According to this invention there is provided a radio antenna which is physically dimensioned to be less than ten percent of the intended operating wavelength, and in which the power to be transmitted is connected from a low impedance feeder via an inductive component, or a parallel set of inductive components, connected to a low impedance tap on a radio-frequency autotransformer which has a capacitive component connected to be in parallel resonance, the first inductive component or components being used to stimulate the principal in-phase radio-frequency magnetic field and the capacitive component being used to stimulate the principal in-phase electric field and the said two fields being placed so as to cross-stress the space surrounding the antenna in an interaction zone, the resonant circuit having the electric field in phase with the potential upon the capacitive stimulator but in the said circuit the current fed to the resonant transformer being directed through parallel parts of a toroidal coil in order to stimulate the necessary in phase magnetic field thus resolving the criterion of in-phase electrical alternation of electric and magnetic fields.

A radio antenna according to this invention will be physically dimensioned to be less than ten percent of the intended operating wavelength, and has the power to be transmitted conducted into two reactive components of inductive and capacitive nature in resonance, the first component being used to stimulate the principal in phase radio-frequency magnetic field and the second component being used to stimulate the principal radio-frequency electric field and the said two fields being placed so as to cross-stress the space surrounding the antenna called the interaction zone and arranged so that five of the six essential criteria of Poynting Vector Synthesis can be achieved, it being a natural feature of the resonant circuit that the electric field is in phase with the potential upon the capacitive stimulator but in the said circuit the current fed to the resonant transformer being directed through parallel parts of a toroidal coil in order to stimulate the necessary in phase magnetic field thus resolving the necessary most significant criterion of in-phase electrical alternation of electric and magnetic fields.

Preferably the radio antenna has an electric field stimulator which is a hollow cylinder with or Without a sliding telescoping section within held vertically above a toroidal magnetic stimulator mounted horizontally above a non-magnetic metal plane with its end connections connected to the said E-plate and the plane with or without a trimmer capacitor connected in parallel across the resonator coil.

The electric field stimulator may be constructed as a hollow cone which is able to be moved so as to adjust its electrical capacity to the said terminating plane.

The electric field stimulator can be further constructed as a hollow cone electrically connected to a hollow cylinder either fixed to the said cone or in sliding contact with same.

In one version either the electric field stimulator or the non-magnetic plane are shaped to apply the said field in a special manner to produce non uniformly directed radiation.

The electric field may be stimulated by a loop conductor and the magnetic field stimulated by a second loop conductor located in close proximity. The conductors may be firstly the outer screen and secondly the inner conductor of a loop of coaxial cable.

More than one turn can be used for either or both of the said conductor loops.

The radio antenna according to this invention may used in conjunction with a conducting sheet or mesh of any shape held in a position designed to obstruct radiation in an unwanted direction or to improve radiation by reflection in a preferred direction or directions.

A remotely controlled trimmer capacitor can be incorporated in order to vary the frequency of operation from a distance.

Two or more individual antennas according to this invention can be provided which are arranged to interact so as to produce a shaped pattern of directivity as in a conventional phased array.

The radio antenna according to this invention may be located near other metal rods or arrays of such conductors in order to parasitically affect the radiation in directivity as in the previously known science of parasitic arrays or located at the focus of a parabolic reflector whether fixed or steerable for enhancement of transmission or reception in a designed direction or directions.

In a more specific and preferred embodiment the radio transmitting or receiving antenna is physically compact being typically no more than three percent of a wavelength in any dimension. The antenna comprises two electrical conducting surfaces across which radio frequency electric field lines carrying half the power are arranged to cross radio frequency magnetic field lines carrying the remaining half power to thereby synthesise and propagate radio waves. A low impedance coaxial feeder passes power from the transmitter through a set of coils (preferably four) wired in parallel and lying in a toroidal pattern to create a circular RF magnetic field H and then enters a low impedance tap on a resonant autotransformer used to connect a high RF voltage and create a curving electric field E across the interaction zone in the volume between the two electrical conducting surfaces which may be an upper metal cylinder and a ground plane.

The radio antenna according to this invention may be used for many purposes including two way wireless telegraphy, one way transmission or reception and where the user is human or automatic and located in a fixed location or mobile platform on land, sea, air or space.

(h) BRIEF DESCRIPTION OF THE SEVERAL VIEWS OF THE DRAWING(S)

Figure 6:
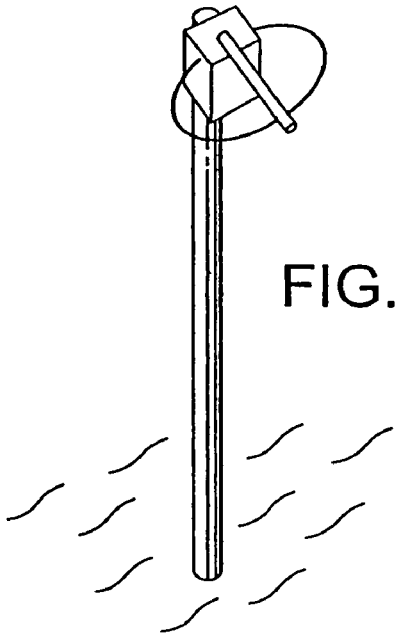
Figure 7:
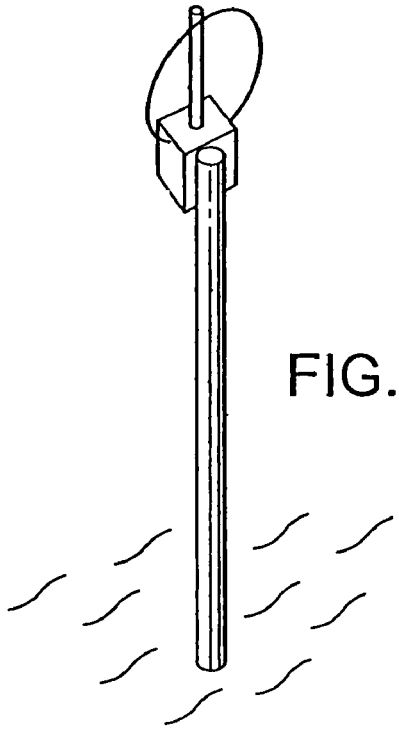

This invention is further described and illustrated with reference to the drawings showing embodiments by way of examples only. In the drawings:

FIG. 1. (A, B and C) shows a first constructional embodiment of this invention, FIG. 2. (A and B) shows a modified constructional embodiment of this invention, FIG. 3. (A and B) shows a modification of the embodiment of FIG. 2, FIG. 4. (A, B and C) shows an embodiment using a loop arrangement, FIG. 5. shows a modification of the loop embodiment shown in FIG. 4, FIG. 6. shows the loop of FIG. 5 mounted horizontally, and FIG. 7. shows the loop of FIG. 5 mounted vertically.

(i) DETAILED DESCRIPTION OF THE INVENTION

Figure 1B:
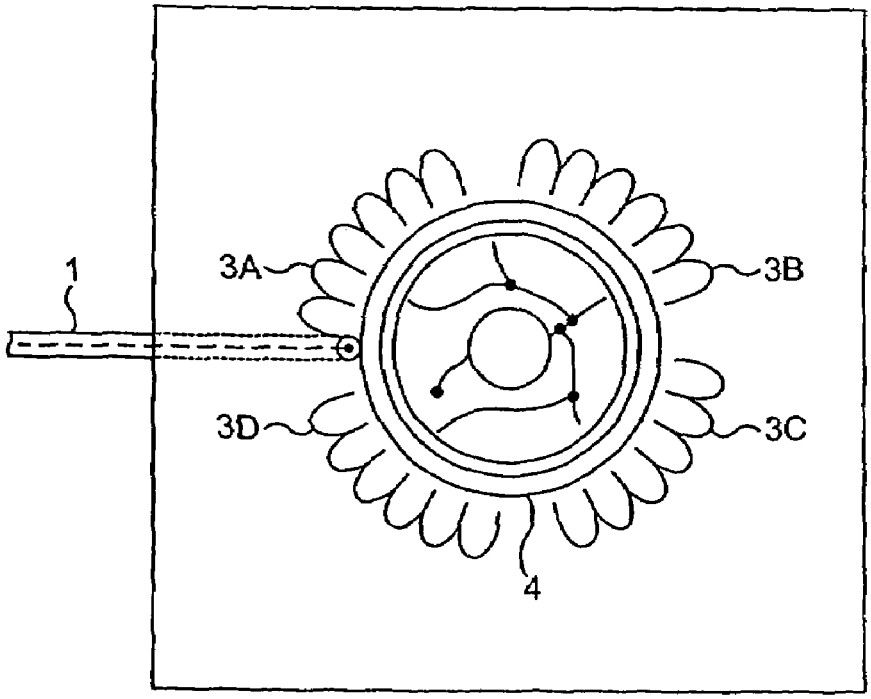
Figure 1C:
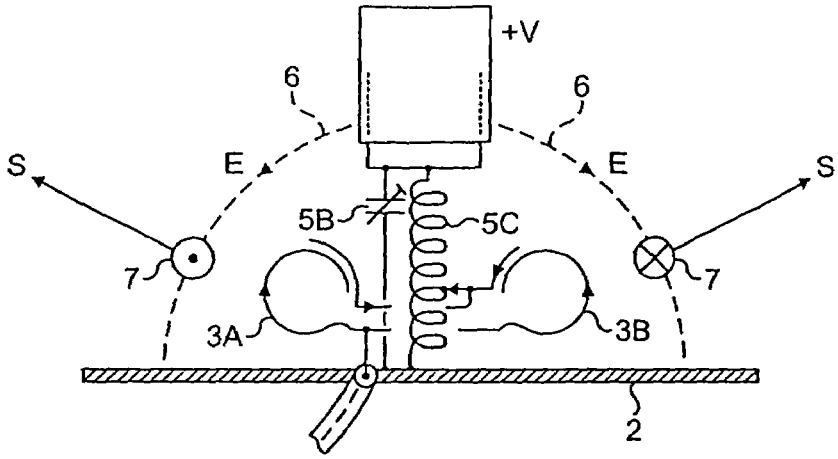

Referring to the drawings the basic antenna of this invention is shown in FIGS. 1A, 1B and 1C. FIG. 1A is a cross-sectioned elevation of the antenna and showing the construction. The radio frequency power for the antenna enters via a low impedance coaxial feeder cable 1 whose screen is connected electrically to the metal ground plane 2 and whose inner conductor carries the current into the several insulated sections of the toroidal coils 3A to 3D (not containing any magnetic material) lying horizontal but insulated from the other parts being eventually connected after totalling some 10 to 50 turns to both the topmost hollow non-magnetic metal cylinder 4 which is the electric field stimulator typically 1 or 2 percent of a wavelength in height with a similar telescopic trimming section 5A or a trimmer capacitor 5B which may be mounted anywhere convenient and used to adjust the parallel resonant circuit of the resonator autotransformer 5C and the total capacitance of the cylinder and/or trimmer capacitor to the frequency to be transmitted. FIG. 1B is a plan view of the antenna.

The non-magnetic terminating plane 2 is in size typically 3 percent of a wavelength in dimension and may be square or circular. Its purpose is to capture the lower ends of the myriad population of E field lines travelling from the outer surface of the cylinder called the E-plate which in the field directions at the moment of the cycle shown for study is E-plate at its positive peak voltage in the field path theoretical diagram FIG. 1C, electric field lines E are severally marked 6 and cut across the magnetic field lines H which are severally marked 7 and result in a vast population of photons leaving the antenna on all sides of which just two are shown by arrows marked severally S. The dimensions of the E-plate may be scaled from the appearance of the dimensions of the FIGS. 1A and 1B bearing in mind that the E field lines are to cut the magnetic field lines H circling in a myriad haze above the ground plane with comparable curvatures. The interaction zone where the Poynting Vector Synthesis takes place is therefore most of the space between the ground plane and the E-plate cylinder and the radio power flow S is outwards from the interaction zone all around. Thus this antenna is ideal for omnidirectional radiation of vertically polarised radio waves as would be required for broadcasting and is seen to be much smaller than typical conventional radio antennas such as the vertical half-wave dipole or the quarter wave monopole.

What is particularly advantageous in this form of antenna when compared with the prior constructions is that the phasing is obtained automatically with the adjustment to resonance of a single tuned circuit. In the earlier designs the two resonance circuits to be adjusted were required to be slightly off-tune so the 90 degree phase change can be composed by use of the plus and minus 45 phase error native to the off-tune inductive-capacitive resonant circuits. Operators found the adjustment to their optimum of the said dual off-sets difficult to perform.

Figure 2A:
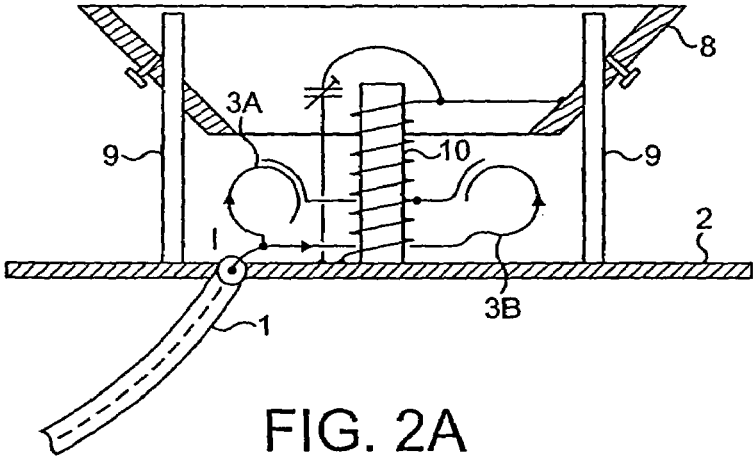
Figure 2B:
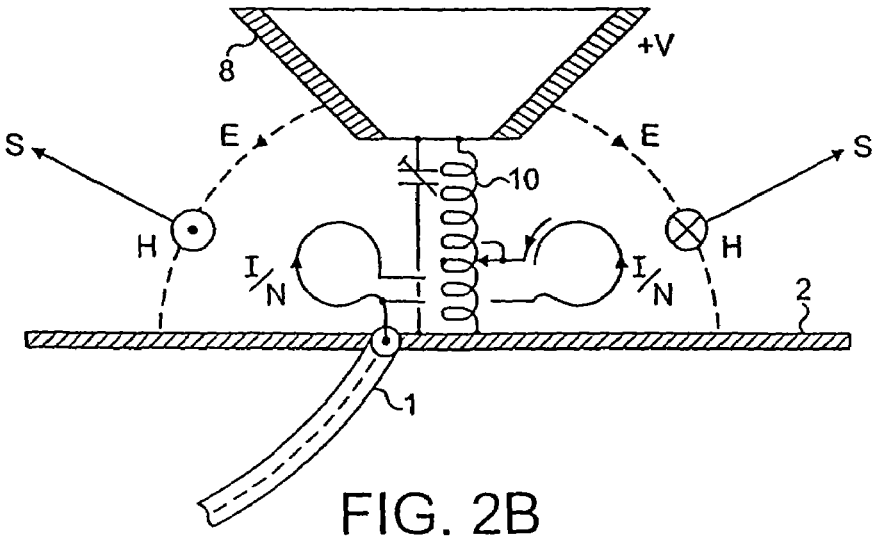
Figure 3A:
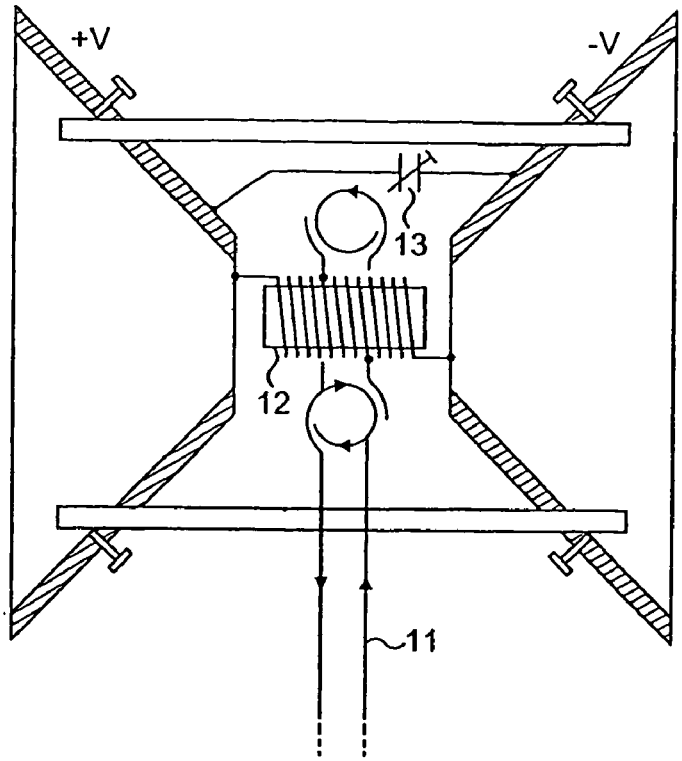
Figure 3B:
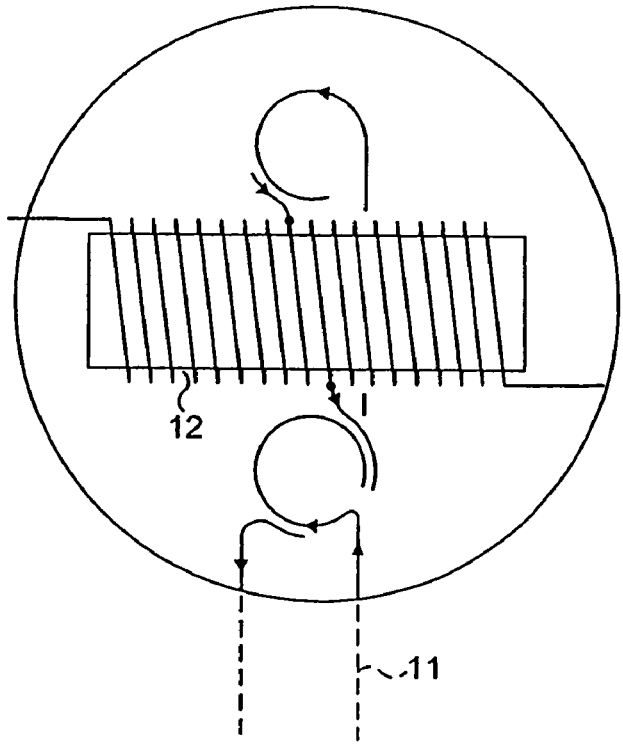

FIG. 2A shows a developed form of antenna according to this invention in which two modifications are incorporated in order to give more freedom to the designer and therefore better efficiency and wider bandwidth. The metal E-plate is now constructed in a conical form 8 so that its capacity to the ground plane is greater than that of the cylinder type and the curvature of the electric field lines are more uniformly comparable to the magnetic lines, mounted on insulated pillars 9 allowing for adjustment of the capacity of the E-plate and hence of the resonant frequency. Also there is shown a resonator coil 10 mounted vertically within the conical E-plate. This feed produces the said freedom for the designer to optimise input impedance but it also makes the voltage on the E-plate positive at the time of the cycle shown for study (see the field analysis diagram FIG. 2B). The current I from the transformer being high impedance comparable in magnitude at resonance to the feed current I/N flowing in each of the N feeds being summed to the tap on the resonator coil is large and in phase with the E-plate voltage. When the radiation commences both of the above forms of the antenna according to this invention experience their tuned circuit become more heavily damped by the extra loss due to the energy radiated to space. They therefore have a reduction in voltage and current automatically producing benign bandwidth behaviour. Should a balanced antenna giving horizontal polarisation be required the design of FIGS. 3A and 3B may be used. Here the balanced feeder 11 is connected across a few turns at the back portion of the resonator coil 12 shown within the sectioned diagram and the near-ends of the said coil used for connection to the two conical E-plates marked +V and −V and to which the trimmer capacitor 13 is attached.

Figure 4A:
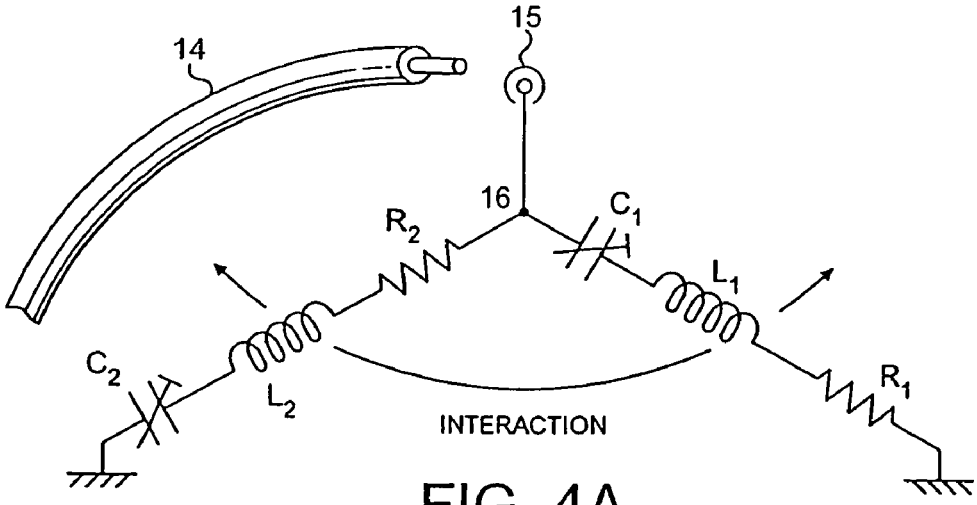

To incorporate the ideas disclosed here for use in the antennas disclosed in the prior patent specifications it is observed that these antennas relied upon interaction of an RF electric field emanating from the surface of one conductor and the RF magnetic field caused by the nearby current carrying conductor. FIG. 4A (taken from GB 2 330 695A) shows the equivalent circuit of the head unit and how the oppositely connected series resonant circuits have their working parts displaced in the loop so that the necessary interaction of E and H fields can occur and the Poynting vector be synthesised.

Figure 4B:
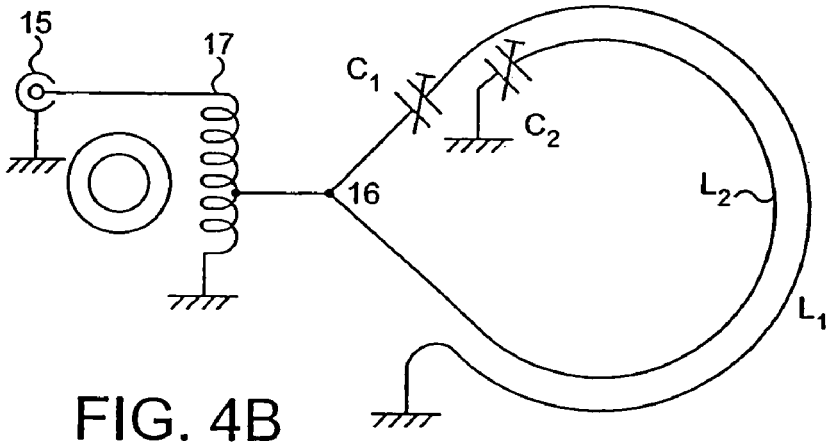
Figure 4C:
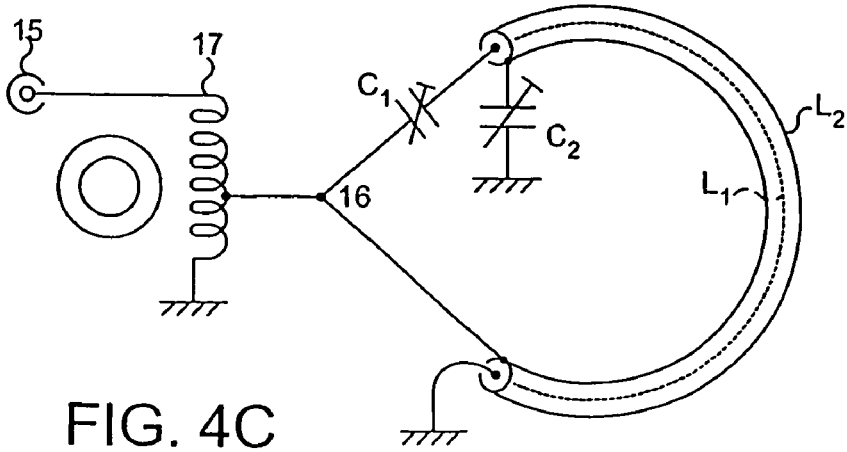
Figure 5:
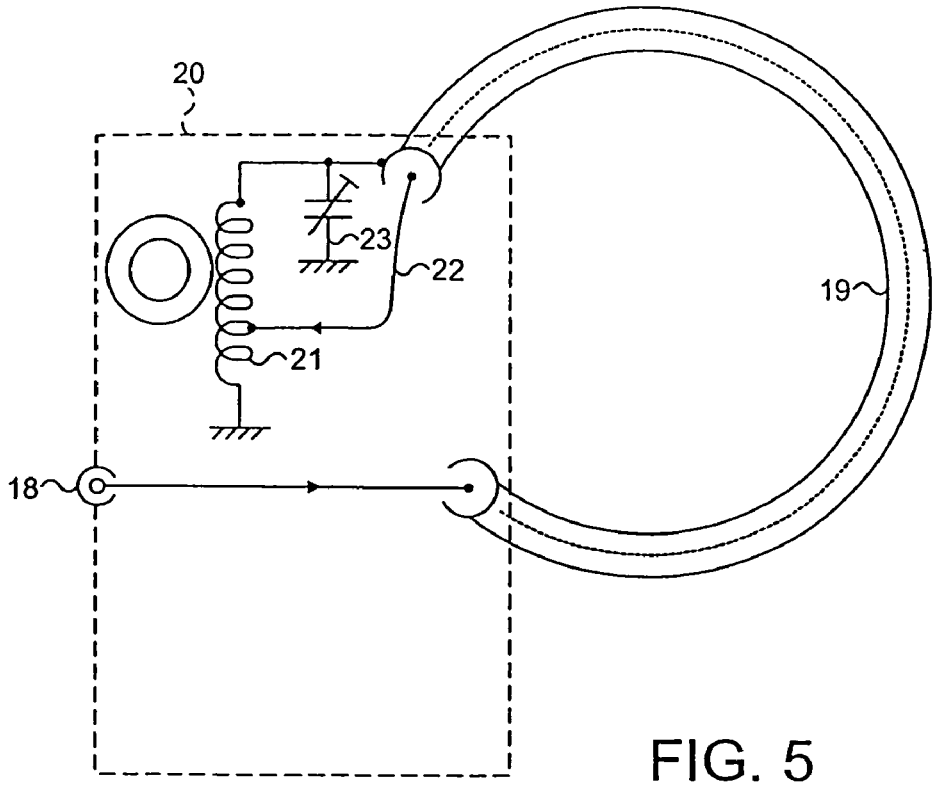

Coaxial Feeder 14 brings the power from the transmitter on the ground to the head unit via socket 15 and thence to split point 16 directly, or via a transformer 17, FIG. 4B (taken from GB 2 330 695A) shows the actual layout of the conductors being in dimensions typically just 1 percent of a wavelength in diameter. The two resonance circuits are fed from the said split point and are adjusted in manufacture by trimmer capacitors C1 and C2 in series with the inductances L1 and L2 of the two loop conductors. And FIG. 4C similarly shows the physical construction of the coaxial form of dual conductor loop head unit. As with the earlier crossed field antennas in the dual loop crossed field antenna, in order to obtain the necessary 90 degree phase difference in the current producing the magnetic field and the voltage from the conductor providing the electric field then the resonant circuits have to be slightly off-tuned in order to give plus and minus 45 degrees and thence the total 90 degrees. As will be shown below when the concept of the present disclosure is employed, the alignment procedure mentioned in Patent GB 2 330 695B becomes unnecessary. There is now just one single tuned circuit to be resonated, a circuit which on adjustment becomes the sole and exact source of the exact phase relationship between the E and H fields. FIG. 5 shows the physical construction of the head unit of the loop form of the antenna according to this invention. The power arrives from the transmitter via a coaxial feeder (not shown) and is connected at the socket 18. The diameter of the coaxial loop 19 is typically about 1 percent of the radiated wavelength. The circuit components for the phasing resonator are contained within a waterproof enclosure 20 and consist of a voltage step-up autotransformer 21 wound on an iron-dust or ferrite core resonated by the capacitor 23 connected to the outer screen 19 from which the electric field lines flow outwards. The inner conductor 22 of the loop carries the current from the feeder socket 18 flows to the input tap on the resonator transformer 21. Adjustment of the number of turns and the size of the loop and the trimmer capacitor will enable the designer to obtain resonance at any desired frequency and the number of turns on the autotransformer tap will allow appropriate matching impedance to the source to be obtained. The loop may be mounted either horizontally as in FIG. 6 or vertically as in FIG. 7. Tasks for which this loop antenna is specially recommended include communications from mobiles such as aircraft, ships, satellites, personal telephones, aerials of minimal visual impact, but also covert and clandestine fixed stations. All the antennas disclosed in this application, like all known radio aerials, are reciprocal in behaviour; in other words they will receive and transmit radio signals with excellent efficiency. The signals captured by these antennas are entirely comparable with those received by antennas of the conventional half-wave dipole design and they are therefore ideal for use with transceiver equipment. The concept of aerial "aperture" has little meaning for an antenna according to this invention except to say that these devices must be reciprocal in a new sense being that of emitting or capturing photons.

The radio antenna of this invention can be used for any industrial or medical or research purpose such as nuclear fusion, radio therapy, radio astronomy, locating buried ordinance, cable location, security observation, pest extermination, crop stimulation or cleaning or any other agricultural procedure.

(I) SEQUENCE LISTING (See MPEP § 2424 and 37 CFR 1.821–1.825.

(not applicable)

The invention claimed is:

1. A radio antenna which is physically dimensioned to be less than ten percent of the operating wavelength, and wherein the power to be transmitted is connected from a low impedance feeder via an inductive component, connected to a low impedance tap on a radio-frequency resonant autotransformer which has a capacitive component connected to be parallel resonant, wherein the inductive component is used to stimulate the principal in-phase radio-frequency magnetic field and wherein the capacitive component is used to stimulate the principal in-phase radio frequency electric fields, and in a resonant circuit the current fed to the resonant autotransformer is directed through parallel parts of a toroidal coil.

2. A radio antenna according to claim 1 which has an electric field stimulator which is a hollow cylinder with a sliding telescoping section within, held vertically above a toroidal magnetic stimulator mounted horizontally above a non-magnetic metal plane with its end connections connected to the said E-plate and the plane with a trimmer capacitor connected in parallel across a resonator coil.

3. A radio antenna according to claim 2 with an electric field stimulator constructed as a hollow cone electrically connected to a hollow cylinder fixed to the cone.

4. A radio antenna according to claim 2 in which either the electric field stimulator or the non-magnetic plane are shaped to apply the said field in a manner to produce non uniformly directed radiation.

5. A radio antenna according to claim 4 in which the conductors are firstly the outer screen and secondly the inner conductor of a loop of coaxial cable.

6. A radio antenna according to claim 2 with an electric field stimulator constructed as a hollow cone electrically connected to a hollow cylinder in siding contact with the cone.

7. A radio antenna according to claim 1 with an electric field stimulator constructed as a hollow cone which is able to be moved so as to adjust its electrical capacity to a terminating plane.

8. A radio antenna according to claim 7 with the electric field stimulator constructed as a hollow cone electrically connected to a hollow cylinder fixed to the cone.

9. A radio antenna according to claim 7 in which either the electric field stimulator or a non-magnetic plane are shaped to apply the said field in a manner to produce non uniformly directed radiation.

10. A radio antenna according to claim 7 with the electric field stimulator constructed as a hollow cone electrically connected to a hollow cylinder in sliding contact with the cone.

11. A radio antenna according to claim 1 in which the electric field is stimulated by a loop conductor and the magnetic field is stimulated by a second loop conductor located in close proximity.

12. A radio antenna according to claim 11 in which more than one turn is used for either of the loop conductors.

13. A radio antenna according to claim 11 in which more than one turn is used for both of the loop conductors.

14. A radio antenna according to claim 1 used in conjunction with a conducting sheet or mesh held in a position to obstruct radiation in an unwanted direction or to improve radiation by reflection in a preferred direction, or directions.

15. A radio antenna according to claim 1 which has a remotely controlled trimmer capacitor in order to vary the frequency of operation from a distance.

16. A radio antenna which is composed of a two or more individual antennas according to claim 1 which are arranged to interact so as to produce a shaped pattern of directivity as in a phased array.

17. A radio antenna according to claim 1 being located near other metal rods or arrays of such conductors in order to parasitically affect the radiation in directivity as in the previously known science of parasitic arrays.

18. A radio antenna according to claim 1 located at the focus of a parabolic reflector whether fixed or steerable for enhancement of transmission or reception in a desired direction or directions.

19. A radio transmitting or receiving antenna which is physically compact being typically no more than three percent of a wavelength in any dimension the antenna comprising two electrical conducting surfaces across which radio frequency electric field lines each carrying half the power are arranged to cross radio frequency magnetic field lines carrying the remaining half power to thereby feeds through a set of coils wired in parallel and lying in a toroidal shape to create a circular RF magnetic field and then passes to a low impedance tap on a resonant autotransformer used to connect a high RF voltage and create a curving electric field across the interaction zone in the volume between the two electrical conducting surfaces.

20. A radio transmitting or receiving antenna comprising two electrical conducting surfaces across which radio frequency electric field lines each carrying half the power are arranged to cross radio frequency magnetic field lines carrying the remaining half power to thereby feeds through a set of coils wired in parallel and lying in a toroidal shape to create a circular RF magnetic field and then passes to a low impedance tap on a resonant autotransformer.

* * * * *